US008614725B2

(12) United States Patent
Ishii et al.

(10) Patent No.: US 8,614,725 B2
(45) Date of Patent: Dec. 24, 2013

(54) REWRITABLE PRINTER

(75) Inventors: Hiroyasu Ishii, Shizuoka-ken (JP); Motohito Tsuchiya, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 113 days.

(21) Appl. No.: 13/293,287

(22) Filed: Nov. 10, 2011

(65) Prior Publication Data

US 2012/0212556 A1 Aug. 23, 2012

(30) Foreign Application Priority Data

Feb. 22, 2011 (JP) ..... 2011-035963

(51) Int. Cl.
*B41J 11/00* (2006.01)

(52) U.S. Cl.
USPC ..... 347/179

(58) Field of Classification Search
USPC ..... 347/171, 179, 222
See application file for complete search history.

(56) References Cited

U.S. PATENT DOCUMENTS

| | | | | |
|---|---|---|---|---|
| 8,284,220 | B2 * | 10/2012 | Takayama et al. | 347/171 |
| 8,284,221 | B2 * | 10/2012 | Taguchi | 347/179 |
| 2008/0062236 | A1 * | 3/2008 | Sakurai et al. | 347/179 |
| 2012/0148327 | A1 * | 6/2012 | Taki et al. | 347/179 |
| 2012/0188324 | A1 * | 7/2012 | Oshiro et al. | 347/179 |

FOREIGN PATENT DOCUMENTS

| | | | | |
|---|---|---|---|---|
| JP | 405084957 | * | 4/1993 | 347/179 |
| JP | 2008-006686 | | 1/2008 | |

* cited by examiner

*Primary Examiner* — Kristal Feggins
(74) *Attorney, Agent, or Firm* — Turocy & Watson, LLP

(57) ABSTRACT

In a rewritable printer of one embodiment which reprints information on a rewritable paper with a thermal print system after erasing by heat information printed on the rewritable paper and discharges it to the outside of the printer through a paper issue port, the printer includes an auxiliary guide having a smooth surface, provided at the paper issue port, to guide the rewritable paper, on which information is reprinted, discharged to the outside.

7 Claims, 11 Drawing Sheets

REWRITABLE PRINTER

CROSS-REFERENCE TO RELATED APPLICATION

This application is based upon and claims the benefit of priority from the prior Japanese Patent Application No. 2011-035963, filed on Feb. 22, 2011, the entire contents of all of which are incorporated herein by reference.

FIELD

The disclosure relates to a rewritable printer using rewritable mediums.

BACKGROUND

From the past, a system in which information or data is magnetically recorded is adopted in an ID card, a pre-paid card and the like, for example. In such a magnetic recording system, however, recording of information is easy and superior but it is hard to view the recorded information directly. An owner of the card cannot visually recognize information recorded on the card.

In recent years, it has been advanced to utilize, in practice, a heat-sensitive recording medium, i.e., rewritable medium, with reversibility in which information is not only displayed on but also erased from the surface of the medium and is reprinted as well. A rewritable printer erases information printed on a rewritable medium by applying to the medium a first temperature and rewrites or reprints character information on the medium by applying to the medium a second temperature lower or higher than the first temperature.

Rewritable mediums required by users have various dimensions, in thickness, length and width, respectively and also have a paper quality different from that of papers used in general thermal printers. For example, it has relatively a high elasticity.

Therefore, according to elasticity and length dimension of a rewritable medium, it may cause trouble such that the rear edge of the medium engages in error with a printing section or the front edge thereof engages in error with a paper issue port and thus the printer stops.

BRIEF DESCRIPTION OF THE DRAWINGS

Aspects of this disclosure will become apparent upon reading the following detailed description and upon reference to the accompanying drawings. The description and the associated drawings are provided to illustrate embodiments of the invention and not limited to the scope of the invention, wherein.

DETAILED DESCRIPTION

Figure 1:
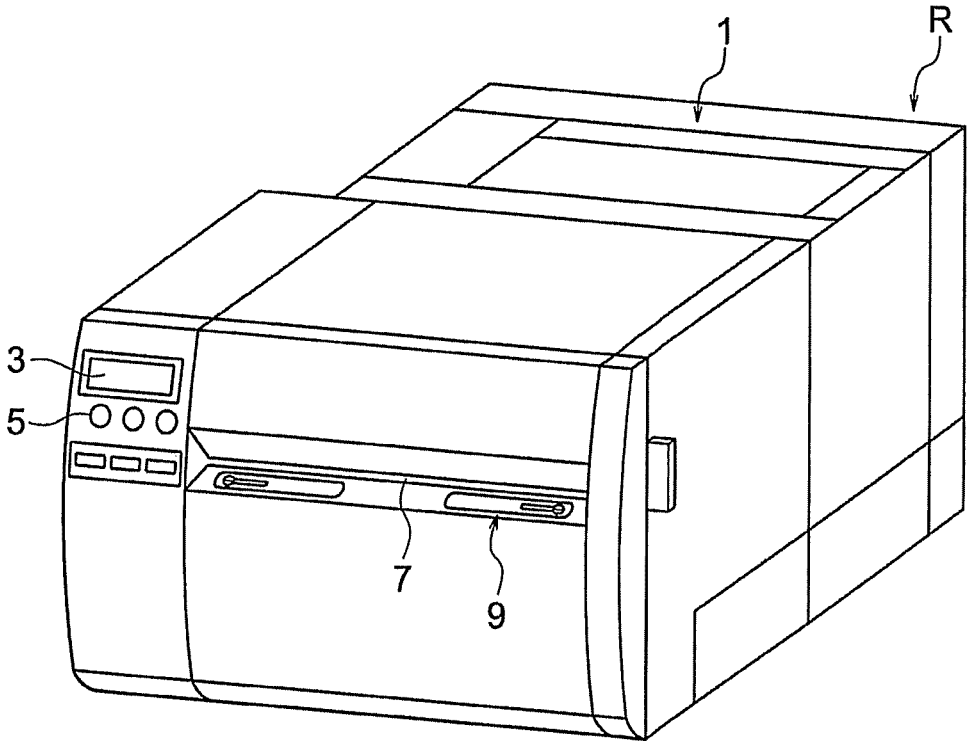
FIG. 1 is an external perspective view illustrating a rewritable printer according to one embodiment.

The present invention has been described with respect to a specific embodiment. However, the embodiment has been presented by way of example only, and is not intended to limit the scope of the present invention. Other embodiments based on the principles of the present invention should be obvious those of ordinary skill in the art. Such embodiments are intended to be covered by the claims.

Embodiment will now be described in more detail with reference to the accompanying drawings. However, the same numerals are applied to the similar elements in the drawings, and therefore, the detailed descriptions thereof are not repeated.

In general, according to an embodiment, it is to provide a rewritable printer, which conveys a rewritable medium one by one, reprints information on the rewritable medium after erasing information printed on the rewritable medium, and smoothly discharges the rewritable medium from a medium issue port thereof. The rewritable printer may include an auxiliary guide provided at the medium issue port for guiding the rewritable medium, on which information is reprinted, discharged to the outside of the printer through the medium issue port.

Embodiment

Figure 2:
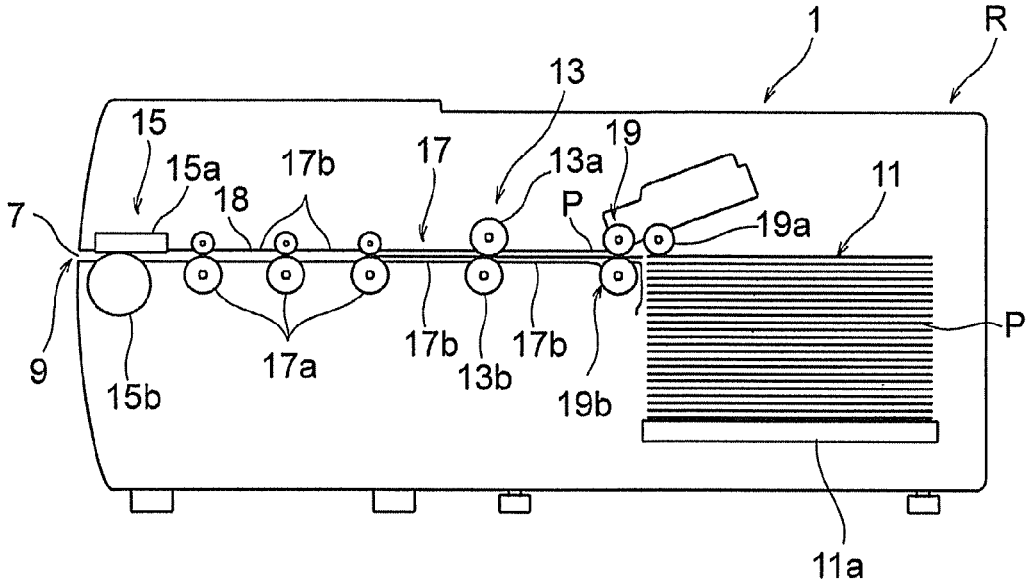
FIG. 2 is a schematic constitutional view illustrating the rewritable printer shown in FIG. 1.

FIG. 1 is an external perspective view of a rewritable printer R according to the present embodiment and FIG. 2 is a schematic side view illustrating an internal configuration of the rewritable printer.

The rewritable printer R is configured to accommodate components or units described later in a housing 1 a rear part of which is narrower than a front part in the width dimension. A display unit 3 and an operation panel 5 are provided in line in an up-and-down direction at a side part (left hand part in FIG. 1) of the front surface of the housing 1 and a paper issue port 7 acting as a medium issue port is provided adjacent to the operation panel 5 along in the width direction of the housing 1.

The display unit 3 is an LCD display device formed in a widthwise fashion. The operation panel 5 is equipped with a plurality of operation change over buttons and indicators respectively corresponding to the buttons. The paper issue port 7 is a slit-shaped opening formed in narrow in the up-and-down direction and in wide in the width direction. The paper issue port 7 is provided with an auxiliary guide 9 described later.

As shown in FIG. 2, a paper storing unit 11 and an erasing unit (erasing section) 13 are housed in the rear part of the housing 1 and a printing unit (printing section) 15 is housed in the front part of the housing 1. In the inside of the housing 1, a paper convey mechanism (paper convey section) 17 for conveying a rewritable paper P is also provided.

The paper convey mechanism 17 forms a paper convey path 18 connecting the paper storing unit 11 and the paper issue port 7. Along the paper convey path 18, the erasing unit 13 and the printing unit 15 are arranged. The erasing unit 13 locates at the upper-stream side and the printing unit 15 locates at the lower-stream side of the paper convey path 18 in the paper convey direction.

The paper storing unit 11 is mainly composed of a movable lifter 11*a*, on which a plurality of rewritable papers P are stacked, driven by a lifter drive unit (not shown) in an up-and-down direction. The paper storing unit 11 is provided with a paper supply mechanism 19 which picks up and feeds the upper-most paper P stacked on the lifter 11*a* one by one to the paper convey path 18.

Rewritable papers P having various kinds of paper quality, i.e., elasticity, and of width and length dimensions, are used by users, respectively. However, a plane (width-length) dimension of the lifter 6*a* naturally limits width and length dimensions of rewritable paper P that is usable. Rewritable papers P have relatively a high elasticity compared with papers used in an ordinary thermal printer because operations of erasing and printing information on the rewritable paper P are performed repeatedly.

The paper supply mechanism 19 is constituted with a pickup roller 19*a* and a separation mechanism 19*b*. The pickup roller 19*a* applies a feeding force to the upper-most rewritable paper P on the lifter 11*a*. The separation mechanism 19*b* functions to separate, when a double-feed or an overlap-feed of the rewritable paper P occurs, the upper-most rewritable paper from a lower paper, and feed only the upper-most rewritable paper P to the paper convey path 18.

The erasing unit 13 includes a heat roller 13*a* and a press roller 13*b*. The heat roller 13*a* is arranged at an upper position with respect to the paper convey path 18 and has an electric heater therein to heat a rewritable paper P conveyed along the paper convey path 18. The press roller 13*b* is located at a lower position opposite to the upper position at which the heat roller 13*a* locates with respect to the paper convey path 18 and elastically contacts with the heat roller 13*a* with a prescribed nip to convey the rewritable paper P by the rotation with the heat roller 13*a*.

The printing unit 15 is arranged in the vicinity of the paper issue port 7 and is mainly composed of a line-type thermal print head 15*a* and a platen roller 15*b* that is arranged opposite to the thermal print head 15*a* through the paper convey path 18. The platen roller 15*b* is urged to elastically contact the thermal print head 15*a*.

The paper convey mechanism 17 includes a plurality of feed roller pairs 17*a* provided at a prescribed interval. Each feed roller pair 17*a* is oppositely arranged such that one of the roller pair is urged to elastically contact the other roller. The other roller is coupled with a known driving mechanism (not shown) to rotate and the one of the roller pair (driven roller) is rotated with the rotation of the other roller.

The paper convey mechanism 17 also includes a plurality of plate-shaped element pairs 17*b* oppositely arranged. A plurality of plate-shaped element pairs 17*b* are respectively provided between the plurality of feed roller pairs 17*a* along the paper convey path 18. The plate-shaped element pair 17*b* is formed with a sheet metal and has a gap therebetween through which a rewritable paper P passes.

In the housing 1, various sensors are provided to send detection signals to a control unit (not shown). Various sensors include an environment temperature sensor for detecting temperature of inside the housing 1 and a supply paper sensor for detecting a supply state of a rewritable paper P from the paper supply mechanism 19. Various sensors also include a paper temperature sensor for detecting temperature of the rewritable paper P passing along the paper convey path 18 and a paper alignment sensor for detecting a state of the rewritable paper P fed to the printing unit 15.

In the rewritable printer R having the above-described constructions, when a print data with a print command is received from an external device, such as a PC (Personal Computer), the control unit drive-controls each constitution part, referring to output signals from the various sensors, and executes erase and print operations based on the print data received.

Firstly, the control unit controls the lifter drive unit to move the lifter 11*a* upward and then the upper-most rewritable paper P contacts the pickup roller 19*a*. Next, the control unit drive-controls the pickup roller 19*a* and the separation mechanism 19*b* constituting the paper supply mechanism 19 and the upper-most rewritable paper P is picked up and fed to the paper convey path 18.

The rewritable paper P is conveyed along the paper convey path 18 and, at the most suitable timing arrived at the erasing unit 13, the heater of the heat roller 13*a* is heat-controlled. Therefore, the surface (image forming side) of the rewritable paper P passing through the erasing unit 13 is heated by the heat roller 13*a* and an image (information) formed on the rewritable paper P is erased due to a slow cooling of the paper P after it passes through the erasing unit 13.

Before the rewritable paper P the image on which is erased is conveyed to the printing unit 15, the control unit sends a print start control signal to the printing unit 15. The printing unit 15 performs, according to the print data received, printing with the thermal print head 15*a* with a thermal print system. The platen roller 15*b* assists the printing action by resiliently pressing the rewritable paper P against the thermal print head 15*a*.

If a heat temperature to the rewritable paper P in the erasing unit 13 is named as a first temperature and a heat temperature to the rewritable paper P in the printing unit 15 is named as a second temperature, the second temperature is extremely higher than the first temperature. However, there is likelihood that the second temperature is lower than the first temperature according to a condition of the rewritable paper P, such as a paper quality and the like.

In any case, printing is carried out on the rewritable paper P, according to the print data received, by cooling after heating that is executed after printing is performed on the rewritable paper P with the thermal print system. Then, after printing, the rewritable paper P is discharged to the outside through the paper issue port 7 where an auxiliary guide 9 is provided and thus is issued.

Hereafter, the rewritable paper P discharged from the paper issue port 7 and the auxiliary guide 9 attached to the paper issue port 7 are described in more detail.

Figure 3:
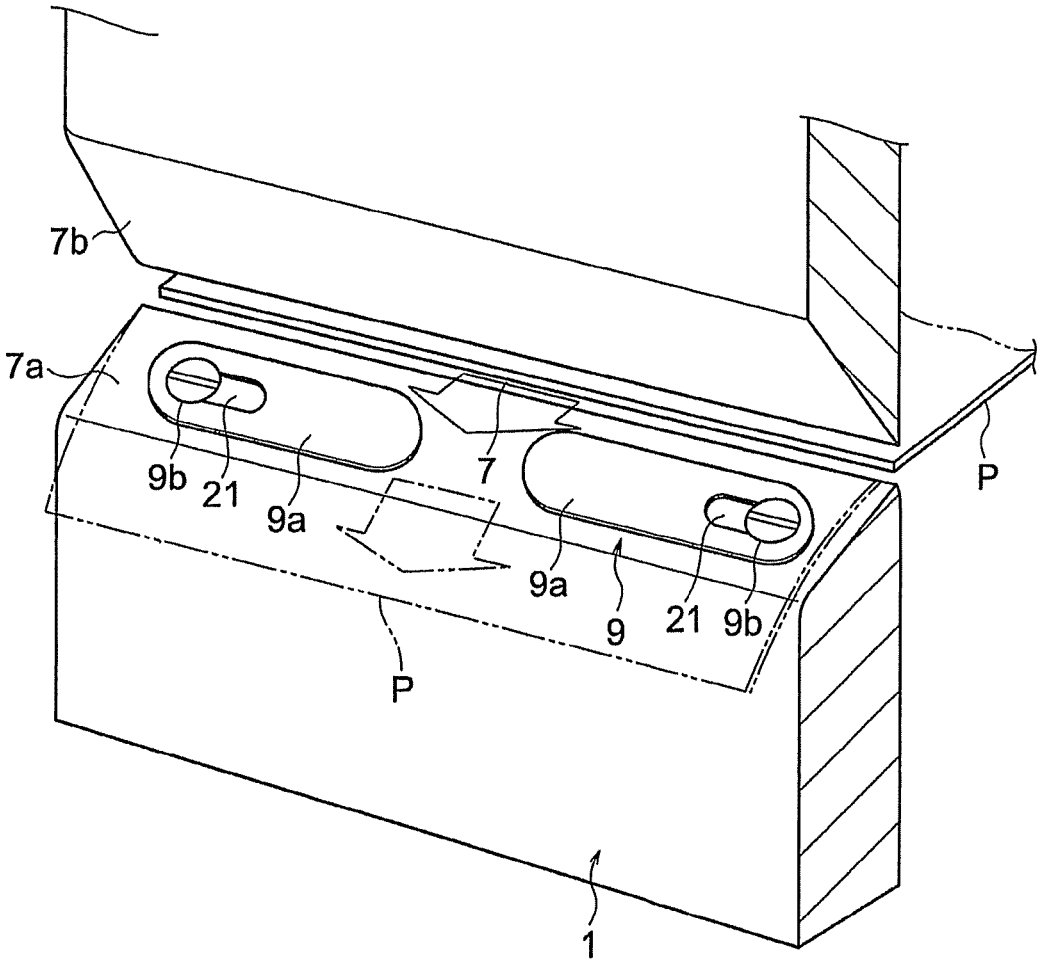
FIG. 3 is a schematic perspective view illustrating a paper issue port of the rewritable printer shown in FIG. 1.
Figure 4:
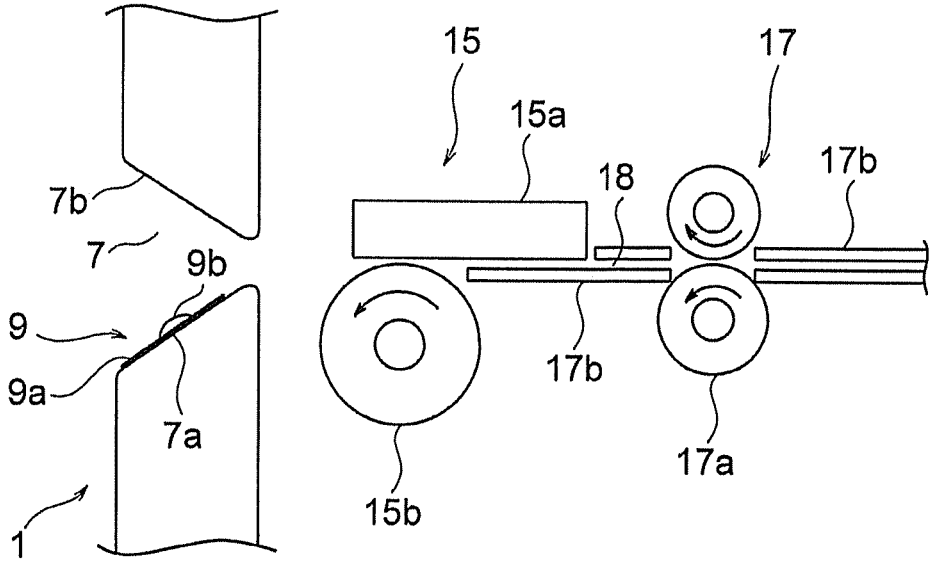
FIG. 4 is an enlarged schematic view illustrating a print section and the paper issue port shown in FIG. 2.
Figure 5:
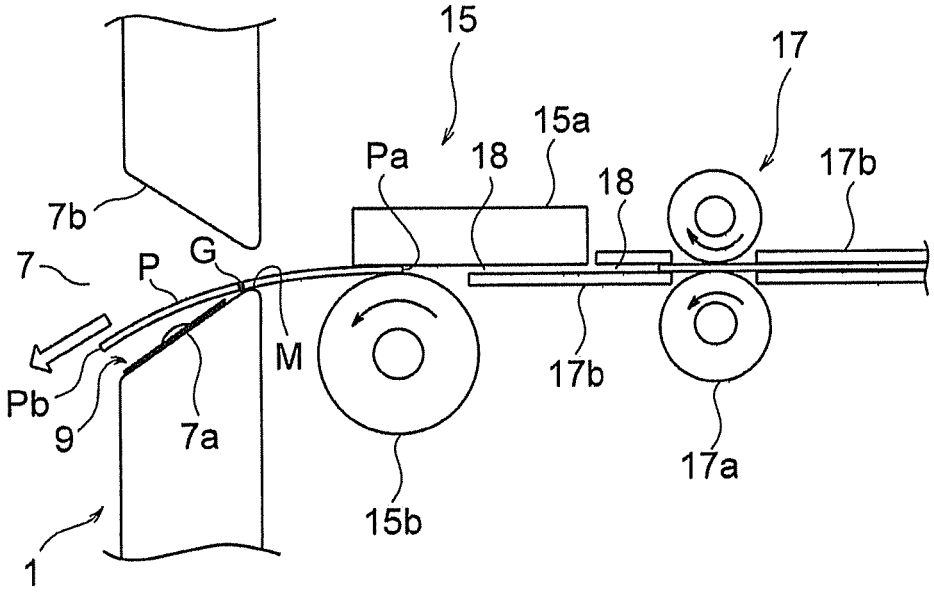
FIG. 5 is an enlarged schematic view illustrating a discharge state of a rewritable paper from the rewritable printer shown in FIG. 4.

FIG. 3 is a schematic perspective view illustrating a paper issue port 7 of the rewritable printer R. FIG. 4 is a schematic view illustrating the printing unit 15 and the paper issue port 7 of the rewritable printer R. FIG. 5 is a schematic view illustrating a state that the rewritable paper P is being discharged from the paper issue port 7 of the rewritable printer R.

As described above, the printing unit 15 is comprised of the thermal print head 15*a* and platen roller 15*b* that are arranged oppositely with respect to the paper convey path 18. In FIGS. 4 and 5, the thermal head 15*a* and the platen roller 15*b* have a gap therebetween. In a practical use, however, the thermal print head 15*a* is resiliently in contact with a part of the circumferential surface of the platen roller 15*b* along its axis direction.

The paper issue port 7 is opened in a slit-shape in the vicinity of the printing unit 15 such that it is provided oppositely against the paper convey path 18 between the thermal print head 15*a* and the platen roller 15*b* and has a short length in the up-and-down direction and a long length in the width direction. It is also arranged such that the upper and lower edges 7*b* and 7*a* of the paper issue port 7 form a slanted surface respectively in a spreading fashion toward the outside of the housing 1 from the inside thereof.

It is required that at least the lower edge 7*a* of the paper issue port 7 is slanted downwardly from the inside of the housing 1 toward the outside as a slanted surface of the lower edge. That is, the front edge of the rewritable paper P conveyed from the printing unit 15 slides along the slanted surface of the lower edge 7*a* of the paper issue port 7 and is discharged smoothly.

On the other hand, it may not be formed that the upper edge 7*b* of the paper issue port 7 has a slanted surface symmetrical with the lower edge 7*a*. It may be formed such that the upper edge 7*b* has a surface parallel with the paper convey path 18. However, it can be easy to visually recognize the discharge state of the rewritable paper P from a diagonal upper direction if the upper edge 7*b* is slanted upwardly toward the outside of the housing 1 from the inside thereof.

The auxiliary guide 9 is provided on the slanted surface of the lower edge 7*a* of the paper issue port 7. The auxiliary guide 9 is composed of a pair of lengthwise auxiliary guide plates 9*a* which has substantially the same width dimension as the slanted surface of the lower edge 7*a* of the paper issue port 7 in a paper discharge direction and respectively has a lengthwise hole 21 at one side thereof and a pair of fasteners (stopper) 9*b* each of which is inserted into respective lengthwise hole 21 of the auxiliary guide plate pair 9*a*.

A pair of screw holes is formed respectively at positions on the slanted surface of the lower edge 7*a* of the paper issue port 7 which are located at an equal distance from the center of the paper issue port 7 in a width direction thereof. A screw portion (not shown) formed at the chip of the stopper pair 9*b* is inserted into the screw hole pair, respectively. Therefore, the stopper pair 9*b* respectively fixes the auxiliary guide plate pair 9*a* on the slanted surface of the lower edge 7*a* of the paper issue port 7.

The auxiliary guide plate 9*a* is made of a thin material having elasticity, e.g., Mylar, whose surface is smooth. A thickness of the guide plate 9*a* is about 0.6 mm, for example. Generally, each auxiliary guide plate 9*a* is arranged along the slanted surface of the lower edge 7*a* of the paper issue port 7 and is fixed with a stopper 9*b*.

However, the position of the auxiliary guide plate 9*a* is adjustable within the length of the lengthwise hole 21 by loosening the stopper 9*b*. An angle and length of the guide plate 9*a* against and projected from the paper issue port 7 are also adjustable. The state (position and posture) of the adjusted guide plate 9*a* is maintained by tightening the stopper 9*b*.

In a state in which a portion of the auxiliary guide plate 9*a* projects from the paper issue port 7, there may be a chance that the rewritable paper P locates on the projected portion of the auxiliary guide plate 9*a*. At this time, the auxiliary guide plate 9*a* has a flexibility to be elastically deformed when the center of gravity of the rewritable paper P is applied on the projected portion thereof.

The paper issue port 7 is not necessarily equipped with a pair of auxiliary guide plates 9*a* as described above. The auxiliary guide 9 may have one guide plate or more than two guide plates. As is described later, however, to be able to make more fine adjustment, it is preferable to have a pair of auxiliary guide plates as shown in FIG. 3 and adjust the guide plate pair on a center basis.

In a rewritable printer R of this kind, before a rewritable paper P is practically issued, it is preferable to conduct a test operation such that a rewritable paper P to be used is conveyed along the paper convey path 18 and is discharged from the paper issue port 7 without printing to confirm whether or not the rewritable paper P is smoothly discharged.

The rewritable paper P can be smoothly discharged as shown in a chain double-dashed line in FIG. 3 or in a solid line in FIG. 5 if the rewritable paper P has a width dimension within a range dischargeable from the paper issue port 7 and has an ordinary elasticity and length dimension.

A further explanation is given below in relation to discharge of the rewritable paper P from the paper issue port 7. A rotation-contact position at which the thermal print head 15*a* of the printing unit 15 contacts the platen roller 15*b* is apart from an inner wall surface of the housing 1 where the paper issue port 7 is formed by a prescribed amount, e.g., 30~40 mm, as shown in FIG. 4. No further means for conveying the rewritable paper P substantially exists after the rear edge Pa of the rewritable paper P leaves the rotation-contact position. Therefore, the rewritable paper P conveyed by the platen roller 15*b* might stop if the rear edge Pa of the rewritable paper P goes over the rotation-contact position.

However, as particularly shown in FIG. 5, the front edge Pb of the rewritable paper P in the conveying direction projects toward the outside of the paper issue port 7 as it leaves the lower edge of the slanted surface 7*a* of the paper issue port 7 and position of the center of gravity G of the rewritable paper P goes over the upper-most point M of the slanted surface 7*a*. Thus, the rewritable paper P itself falls out of the paper issue port 7 such that it moves along the slanted surface 7*a* of the paper issue port 7 with its dead weight, as a natural consequence, to be discharged from the paper issue port 7 smoothly.

At this point, the auxiliary guide 9 does not exert any guide action on the rewritable paper P. On the other hand, if the auxiliary guide 9 is not furnished, according to the elasticity and the length dimension of the rewritable paper P, it may occur that conveying of the rewritable paper P stops at a position that the rear edge Pa of the rewritable paper P goes over the rotation-contact position.

Figure 6:
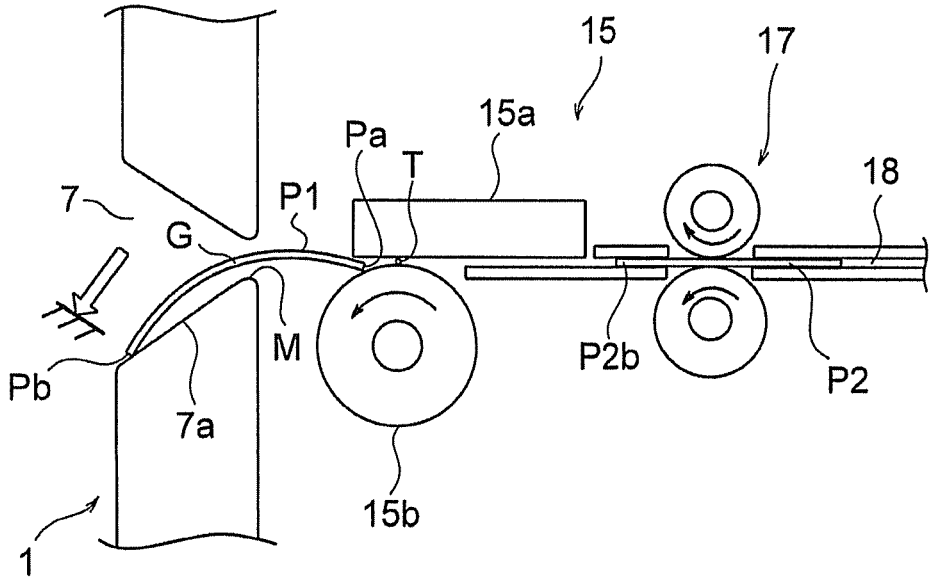
FIG. 6 is an enlarged schematic view illustrating a stuffed state of the rewritable paper at the paper issue port with no auxiliary guide.
Figure 7A:
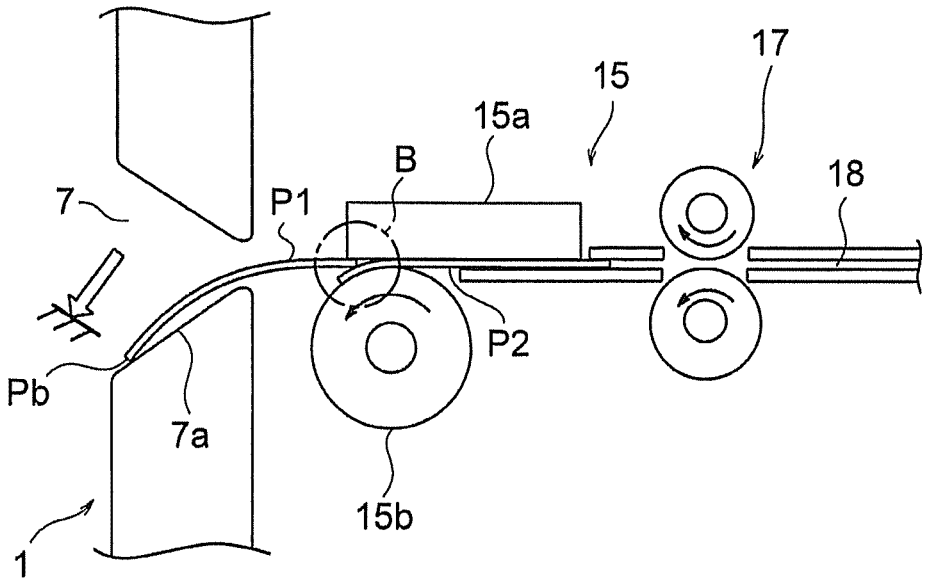
FIGS. 7(A), 7(B) are views illustrating another stuffed state of the rewritable paper advancing from the state shown in FIG. 6 and an enlarged view of its part.
Figure 7B:
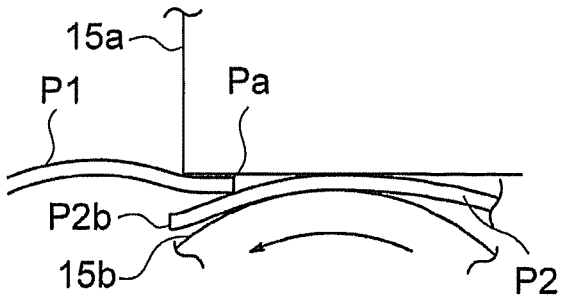

FIG. 6 is a view illustrating a stuffed state of the rewritable paper P in case that the auxiliary guide 9 is not furnished at the paper issue port 7. FIG. 7(A) is a view illustrating an example of the stuffed state of the rewritable paper P advancing from the state shown in FIG. 6. FIG. 7(B) is an enlarged view of a part of the state shown in FIG. 7(A).

As shown in FIG. 6, it may occur that the front edge Pb of the rewritable paper P gets on the slanted surface of the lower edge 7*a* of the paper issue port 7 immediately after the rear edge Pa thereof goes over the rotation-contact position T between the thermal print head 15*a* and the platen roller 15*b* in case that the auxiliary guide 9 is not furnished at the paper issue port 7.

At this moment, position of the center of gravity G of the rewritable paper P1 passes over the upper-most point M of the slanted surface of the lower edge 7*a*. However, in this state, the restoring force of the rewritable paper P1 by its elasticity matches with the paper conveying force of the paper convey mechanism 17 and thus the front edge Pb of the rewritable paper P1 cannot be released from the contact state with the slanted surface of the lower edge 7*a* of the paper issue port 7: As a result, the rewritable paper P1 maintains its deformed posture as shown in FIG. 6.

Therefore, the rewritable paper P1 conveyed stops at a position between the printing unit 15 and the paper issue port 7. At this state, since the paper convey mechanism 17 continuously operates, a succeeding rewritable paper P2 is conveyed to the printing unit 15. Finally, as shown in FIG. 7(A), the front edge P2*b* of the succeeding rewritable paper P2 collides with the rear edge Pa of the rewritable paper P1 which stops.

Then, as shown in FIG. 7(B), the front edge P2*b* of the rewritable paper P2 goes under the rear edge Pa of the rewritable paper P1 and deformation of both papers P1 and P2 occurs at the printing unit 15. Otherwise, papers P1 and P2 are stuffed between the thermal print head 15*a* and the platen roller 15*b* and thus rotation of the platen roller 15*b* stops. Still otherwise, the succeeding rewritable paper P2 pushes the rewritable paper P1 and thus the rewritable paper P1 slips off straightforward in a diagonal posture from the paper issue port 7.

In any case, at a moment that the rewritable paper P1 early conveyed stops, an accidental state between the rewritable paper P1 and the rewritable paper P2 succeedingly conveyed is maintained as long as the paper convey mechanism 17 does not stop promptly. Therefore, the paper convey is stopped and rewritable papers P1 and P2 should be eliminated.

Figure 8:
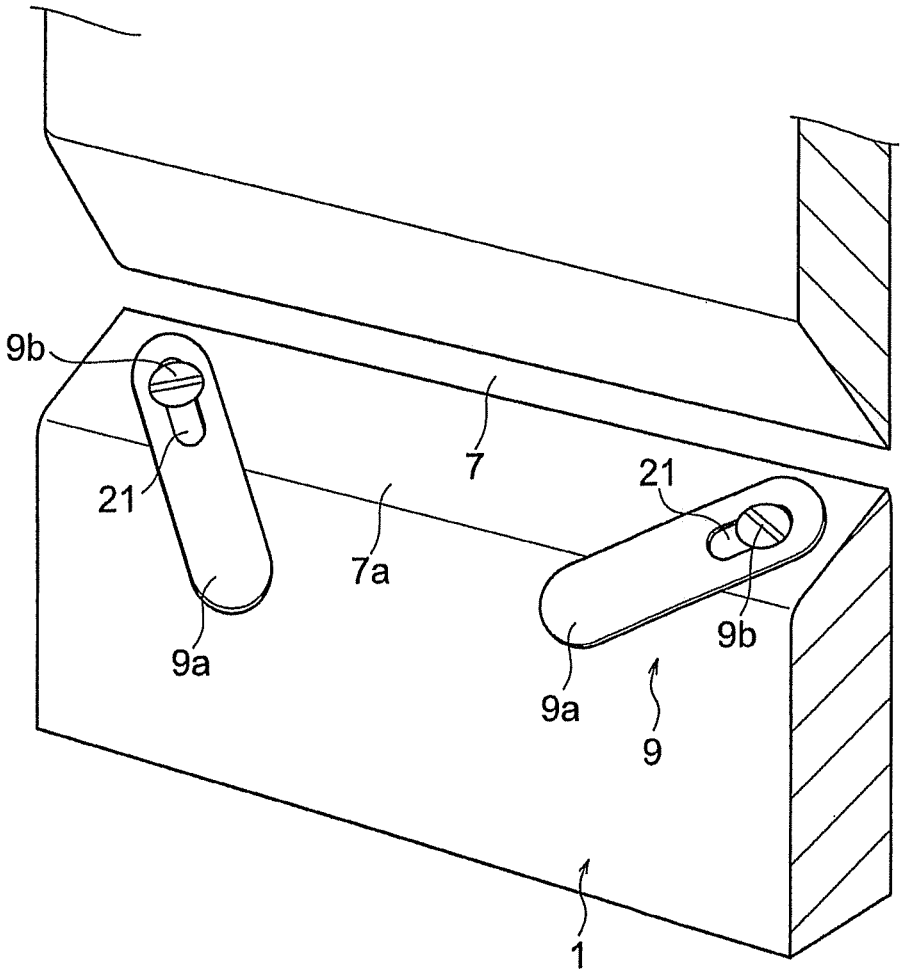
FIG. 8 is a schematic perspective view illustrating a state in which an auxiliary guide plate pair projects from the paper issue port.
Figure 9:
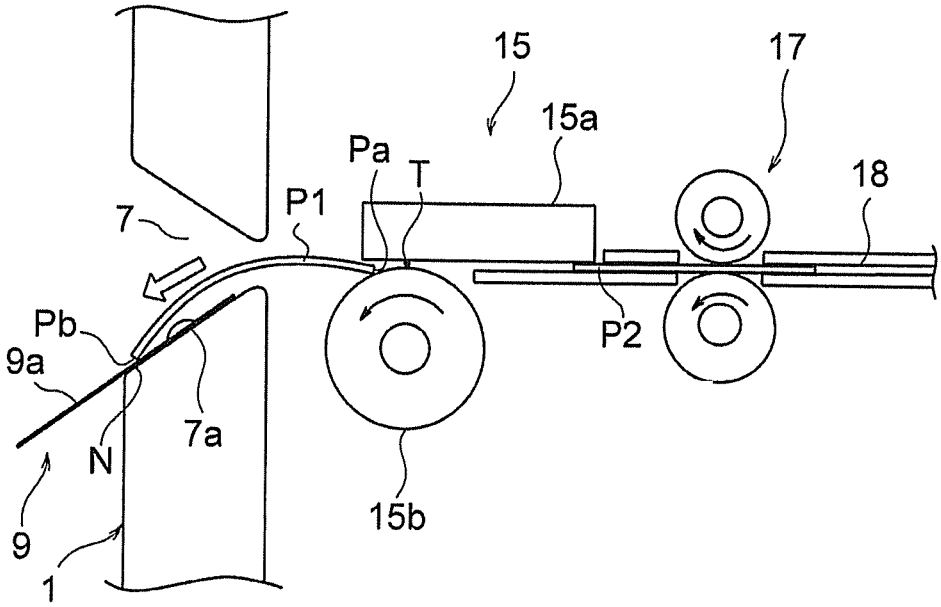
FIG. 9 is an enlarged schematic view illustrating a discharge state of a rewritable paper from the paper issue port shown in FIG. 8.
Figure 10:
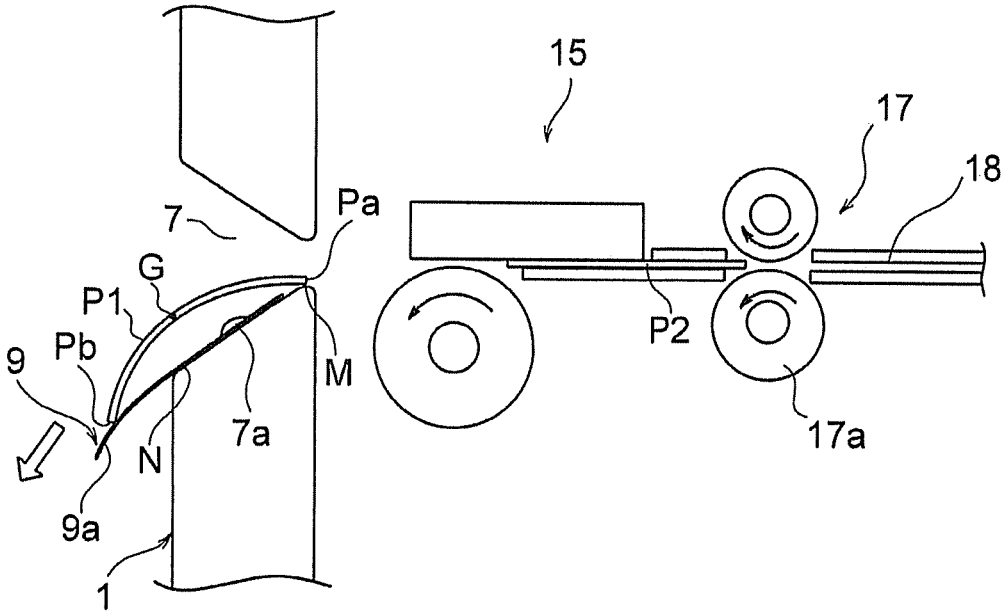
FIG. 10 is a view illustrating another discharge state of the rewritable paper advancing from the state shown in FIG. 9.
Figure 11:
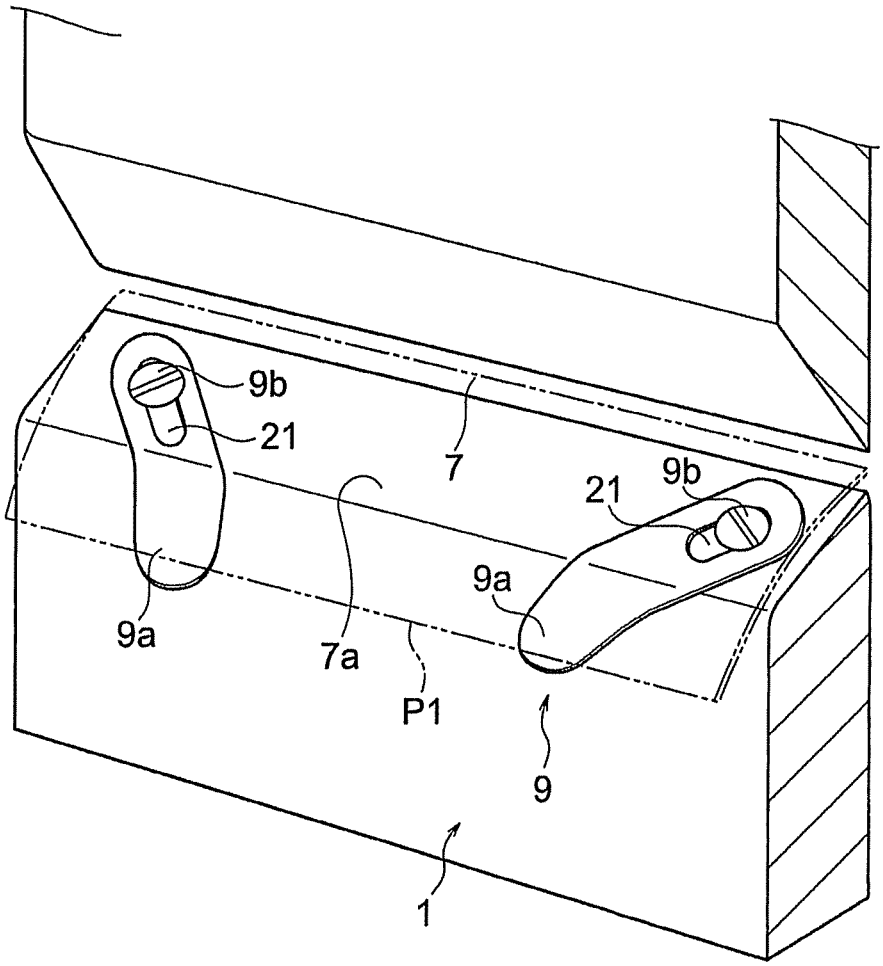
FIG. 11 is a perspective view illustrating the auxiliary guide plate pair in the discharge state shown in FIG. 10.

If the above-described state or a state similar thereto occurs at the test operation even if the auxiliary guide 9 is furnished, following procedures are taken. FIG. 8 is a perspective view illustrating a state that the auxiliary guide 9 projects from the paper issue port 7. FIG. 9 is a view illustrating a state that the auxiliary guide 9 projects and the rewritable paper P is discharged from the paper issue port 7. FIG. 10 is a view illustrating a discharge state of the rewritable paper P progressing from the state shown in FIG. 9. FIG. 11 is a perspective view illustrating an auxiliary guide 9 shown in FIG. 10.

As shown in FIG. 8, each stopper 9*b* of the auxiliary guide 9 is loosened and each auxiliary guide plate 9*a* is rotated around the stopper 9*b* so that one end of the auxiliary guide plate 9*a* projects aslant to the outside from the paper issue port 7 at a prescribed angle. Furthermore, position of the lengthwise hole 21 is adjusted against the stopper 9*b*. As a result, the auxiliary guide plate pair is postured in a symmetrical fashion. Then, trial of conveying the same rewritable paper is restarted.

As shown in FIG. 9, the front edge Pb of the rewritable paper P1 gets on the slanted surface of the lower edge 7*a* of the paper issue port 7 immediately after the rear edge Pa thereof goes over the rotation-contact position T between the thermal print head 15*a* and the platen roller 15*b*. The restoring force of the rewritable paper P1 by its elasticity matches with the paper conveying force of the paper convey mechanism 17 and thus, the rewritable paper P1 maintains its deformed posture (rigid state).

However, in this case, the front edge Pb of the rewritable paper P1 gets on the slanted surface of the lower edge 7*a* of the paper issue port 7 through the auxiliary guide plate pair 7*a*. The auxiliary guide plate pair 9*a* has a smooth surface and is arranged on the slanted surface of the lower edge 7*a* of the paper issue port 7. Therefore, the front edge Pb of the rewritable paper P1 slides along the auxiliary guide plate pair 9*a* smoothly.

Since the whole rewritable paper P1 moves diagonal-downward along the surface of the auxiliary guide plate pair 9*a* on the slanted surface of the lower edge 7*a*, the rear edge Pa thereof goes away by some extent from the rotation-contact position T between the thermal print head 15*a* and the platen roller 15*b*. Concurrently, the front edge Pb of the rewritable paper P1 on the auxiliary guide plate pair 9*a* goes beyond the lower-most point N that represents the front edge of the slanted surface of the lower edge 7*a* and thus gets on only the auxiliary guide plate pair 9*a*.

As shown in FIGS. 10 and 11, the center of gravity G of the rewritable paper P1 further moving downward is applied on the auxiliary guide plate pair 9*a*. The auxiliary guide plate pair 9*a* which receives the weight of the rewritable paper P1 is resiliently deformed with ease and hangs down. In this state, the rear edge Pa of the rewritable paper P1 locates either at the upper-most position M that represents the rear edge of the paper issue port 7 or a position in the vicinity of the upper-most position M.

The rewritable paper P1 rapidly goes further downward, and finally falls down from the paper issue port 7 smoothly. At this moment, a rewritable paper P2 conveyed next to the paper P1 positions at a prescribed interval to the rewritable paper P1 and the rewritable paper P2 does not collide with the preceding rewritable paper P1. Thus no trouble occurs.

It should be avoided that the position, the projection-length and the projection-angle of the auxiliary guide plate pair 9*a* are determined only by one time trial conveyance. It is recommended that a trial conveyance for the rewritable paper is repeatedly performed by changing, step by step, such adjustable items of the auxiliary guide plate pair 9*a* to determine the position and posture of the auxiliary guide plate pair 9*a* that can discharge a rewritable paper smoothly.

Accordingly, the auxiliary guide plate pair 9*a* has lengthwise holes 21 and the stopper pair 9*b* is inserted into the lengthwise holes 21 of the guide plate pair 9*a* respectively to adjust the position and posture of the auxiliary guide plate pair as described above.

As described above, even if rewritable papers have various kinds of elasticity and length dimension, it can be discharged surely from the paper issue port 7 with the auxiliary guide and no collision occurs between a rewritable paper P1 and a succeeding rewritable paper P2 conveyed one by one along the paper convey path 18 to maintain a smooth conveyance.

The present invention has been described with respect to specific embodiments. However, these embodiments have been presented by way of example only, and are not intended to limit the scope of the present invention. Other embodiments based on the principles of the present invention should be obvious those of ordinary skill in the art. Such embodiments are intended to be covered by the claims.

What is claimed is:

1. A rewritable printer comprising:

a housing configured to stack therein a plurality of rewritable papers, information printed on the rewritable paper being erasable by heat;

an erasing section configured to erase information printed on the rewritable paper by heat;

a printing section configured to reprint information on the rewritable paper with a thermal print system after information printed on the rewritable paper is erased by the erasing section;

a paper issue port, formed on the housing, configured to discharge the rewritable paper;

a paper convey section configured to convey the rewritable paper one by one to the paper issue port through the erasing section and the printing section; and an auxiliary guide, provided on the paper issue port, which is configured to guide the rewritable paper discharged to the outside of the housing through the paper issue port, the auxiliary guide being adjustable according to elasticity and length dimension of the rewritable paper in a conveying direction.

2. The printer according to claim 1, wherein the printing section includes a thermal print head and a platen roller arranged to be opposite to the thermal print head, the paper issue port being formed at a position of the housing in the vicinity of the opposing position of the thermal print head and the platen roller and having at least a lower edge which has a surface slanted downward from the inside of the housing toward the outside of the housing.

3. The printer according to claim 2, wherein the auxiliary guide is provided on the slanted surface of the lower edge of the paper issue port.

4. The printer according to claim 3, wherein the auxiliary guide includes a lengthwise auxiliary guide plate having a width substantially the same as a length of the slanted surface of the lower edge of the paper issue port in a paper discharge direction and a lengthwise hole formed at one side thereof and a stopper inserted through the lengthwise hole to fix the auxiliary guide plate on the slanted surface of the lower edge of the paper issue port, wherein the auxiliary guide plate is projected from the paper issue port and fixed by the stopper after the projecting length and angle of the auxiliary guide plate from and to the paper issue port are respectively adjusted at appropriate amounts when the auxiliary guide plate is used.

5. The printer according to claim 4, wherein the auxiliary guide plate is fixed on the slanted surface of the lower edge of the paper issue port by the stopper such that the width of the auxiliary guide plate coincides with the length of the slanted surface of the paper issue port when the auxiliary guide plate is not used.

6. The printer according to claim 5, wherein the auxiliary guide plate has a smooth surface and deforms elastically if the rewritable paper gets on an area of the guide plate projecting from the paper issue port.

7. The printer according to claim 6, wherein the auxiliary guide plate includes an auxiliary guide plate pair provided on the slanted surface of the lower edge of the paper issue port.

* * * * *